US005893605A

United States Patent [19]

Chang

[11] Patent Number: 5,893,605

[45] Date of Patent: Apr. 13, 1999

[54] FOLDABLE CHAIR WITH A CUP HOLDER

[75] Inventor: Tony Wei-Sin Chang, San Jose, Calif.

[73] Assignee: Variety Electronics Inc., San Jose, Calif.

[21] Appl. No.: 09/083,233

[22] Filed: May 21, 1998

[51] Int. Cl.[6] ..... A47C 7/62

[52] U.S. Cl. ..... 297/188.14; 297/16.2; 297/188.19

[58] Field of Search ..... 297/16.2, 35, 59, 297/188.01, 188.14, 188.18, 188.19; 248/311.2

[56] References Cited

U.S. PATENT DOCUMENTS

| | | | |
|---|---|---|---|
| 3,136,272 | 6/1964 | Sprigman | 297/16.2 X |
| 3,233,940 | 2/1966 | Tooley, Jr. | 297/188.18 |
| 3,991,961 | 11/1976 | Platzer, Jr. | 248/311.2 X |
| 5,352,015 | 10/1994 | Morgan | 297/188.01 X |
| 5,662,378 | 9/1997 | Carruth | 297/188.18 X |
| 5,690,036 | 11/1997 | Hasegawa | 248/311.2 X |

*Primary Examiner*—Peter R. Brown

[57] ABSTRACT

A foldable chair having a cup holder. The foldable chair comprises a leg assembly, a seat cloth, and a cup holder. The cup holder being a bag made of fabric or cloth is collapsible. By affixing the cup holder to the edge of the seat cloth, it provides a convenient place for holding a cup or a can. For a foldable chair having a pair of armrests, the cup holder can be integrated into the armrest through an opening formed on the armrest. A flap is provided to cover the opening.

2 Claims, 3 Drawing Sheets

FOLDABLE CHAIR WITH A CUP HOLDER

FIELD OF THE INVENTION

The present invention relates to foldable chairs, and more specifically to foldable chairs having cup holders.

BACKGROUND OF THE INVENTION

Foldable chairs are very popular in recent years. People who love outdoor activities such as camping and watching outdoor sport games usually carry foldable chairs with them. Foldable chairs of various designs have been manufactured for easy porting and carrying around outdoors.

FIG. 1 illustrates an example of a foldable chair. As shown in FIG. 1, a foldable chair generally has a leg assembly 101 that is foldable or collapsible and a seat cloth 102 formed by a piece of strong fabric such as canvas. The leg assembly has a plurality of leg members pivotedly connected together by pivot pins as well as joined together by joint members. The seat cloth 102 is mounted on the leg assembly 101. The seat cloth and the leg assembly may be extended up to form a back support as well.

The foldable chair provides great convenience for outdoor activities. However, as most people may have experienced, it is very inconvenient when a person sitting outdoors on a foldable chair has to hold a can or cup of drink. People often end up putting the cups or cans on the ground and worry that they may be tipped over or kicked down any time.

SUMMARY OF THE INVENTION

The present invention has been made to overcome the above mentioned inconvenience of holding a cup of drink while sitting on a foldable chair outdoors. The primary object of the invention is to provide a cup holder for a foldable chair. The second object is to provide a cup holder that can be folded with the foldable chair. It is also an object of the invention to provide a cup holder that is integrated into an armrest of a foldable chair.

According to this invention, a bag made of collapsible material is clamped or affixed to the edge of the seat cloth of a foldable chair. When the bag is opened up, it has the shape of a cup. Therefore, it can hold a cup or a can of drink. To better support the cup or can, the collapsible cup holder can be affixed to the seat cloth at a location having support form the leg assembly to prevent it from being tipped over.

For a foldable chair that comprises a pair of armrests, the cup holder of the present invention can be integrated into the armrests instead of being affixed to the seat cloth. Because the cup holder is made of collapsible material identical or similar to the material of the seat cloth, it is easily foldable along with the foldable chair.

DETAILED DESCRIPTION OF THE PREFERRED EMBODIMENTS

Figure 1:
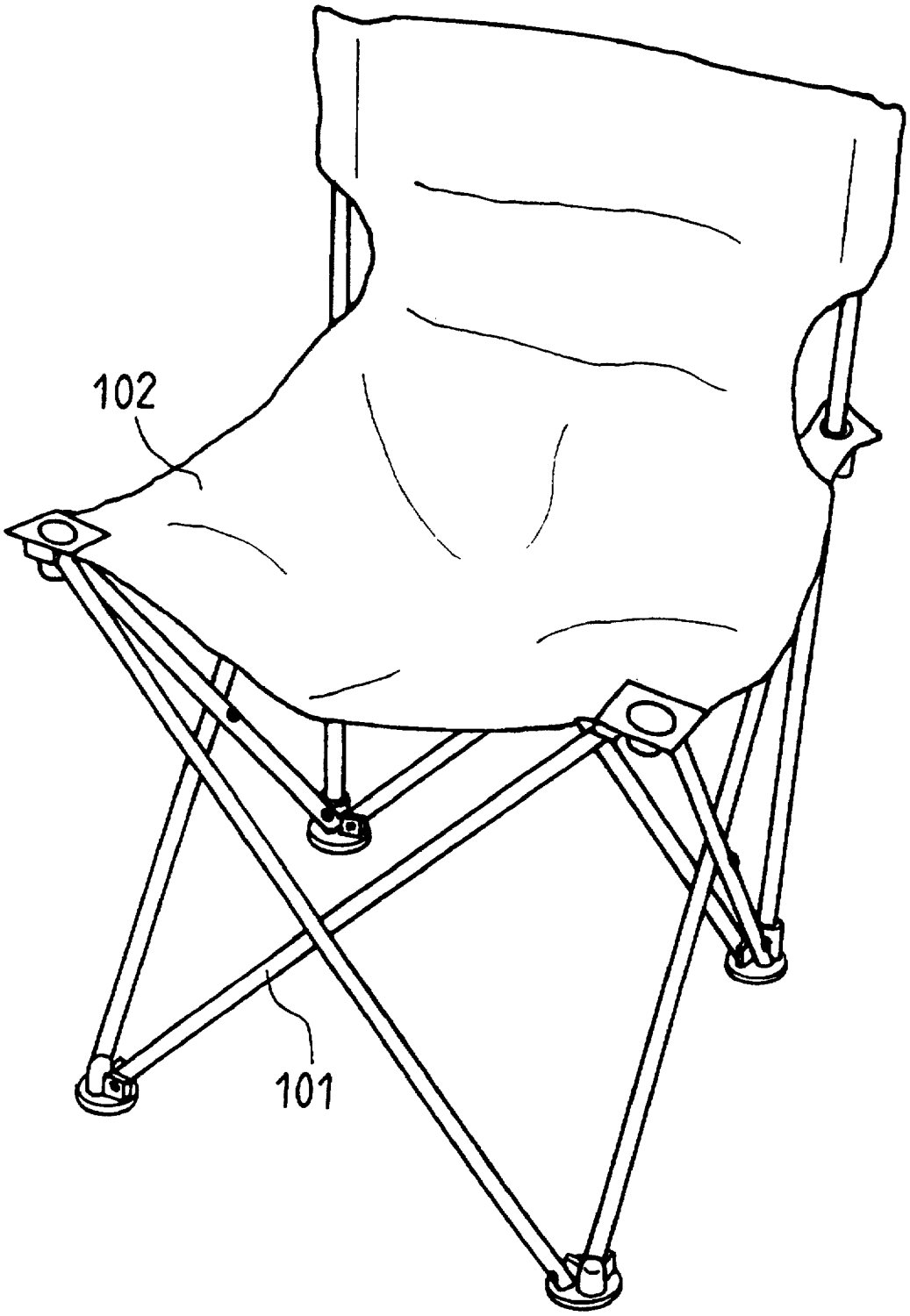
FIG. 1 shows an example of a conventional foldable chair.
Figure 2:
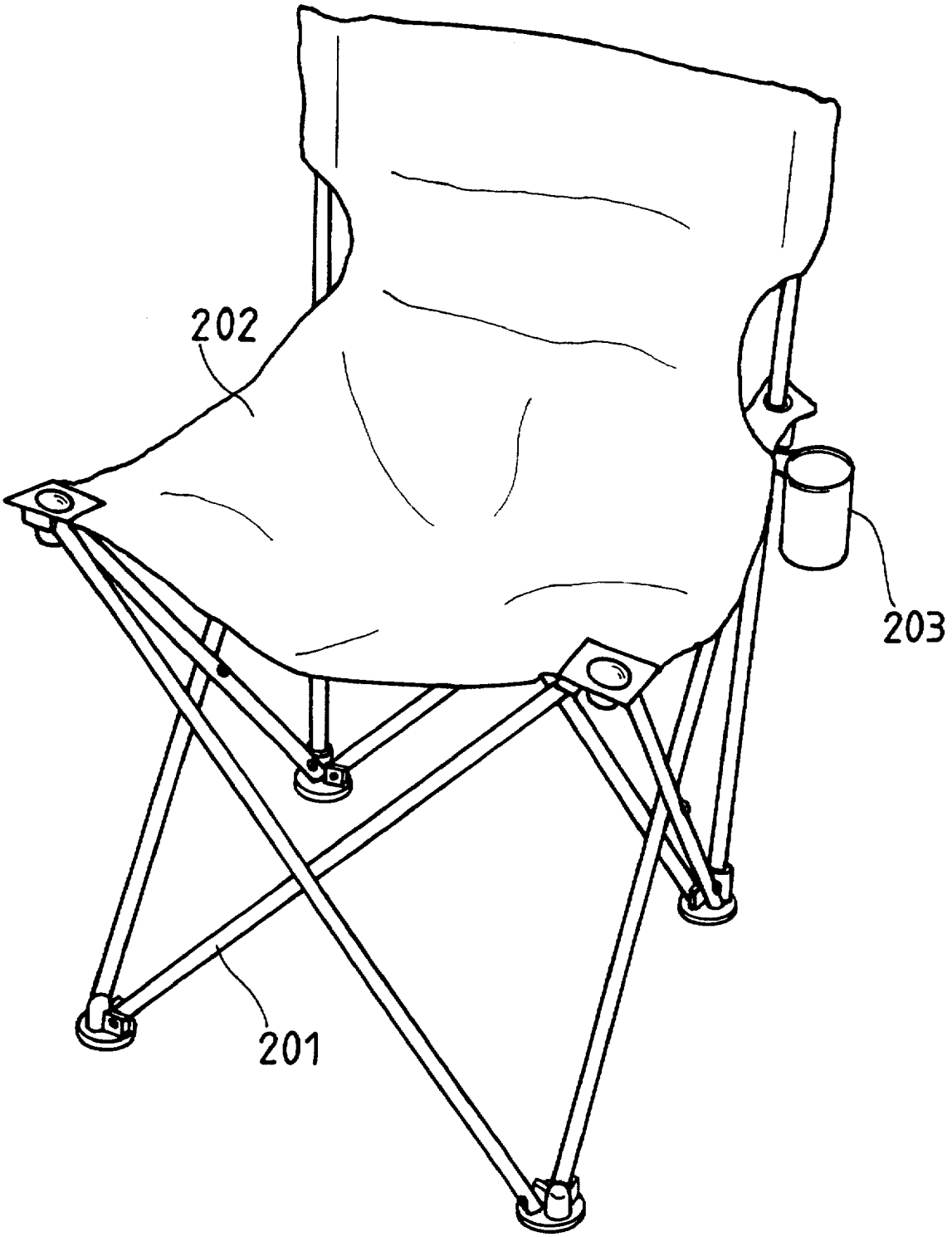
FIG. 2 shows a first embodiment of the foldable chair of this invention in which a collapsible cup holder is affixed to the seat cloth of the chair.

With reference to FIG. 2, a first preferred embodiment of the foldable chair of the present invention comprises a leg assembly 201, a seat cloth 202, and a bag 203. The leg assembly 201 comprises a plurality of rigid leg members hingedly connected together by means of pivotal pins as well as joined together by means of joint members.

The seat cloth 202 is mounted on the leg assembly. When the leg assembly is opened, the leg assembly forms a chair frame and the seat cloth is also opened up by the leg members to form a seat base. The seat cloth is a piece of strong fabric made of canvas or other synthetic fabric. The leg members are held and pulled together by the seat cloth when a person sits on the chair.

The bag 203 has the shape of a cup to form a cup holder when it is fully opened. It has a top opening and a closed bottom for holding a cup or can. The bag may be manufactured by sewing two opposing edges of a rectangular piece of strong fabric together to form a cylinder. A circular piece of fabric is then sewed onto one end of the cylinder for serving as the bottom of a cup holder. The bag can be made of the same material as the seat cloth. The cup holder 203 of this invention is affixed to the edge of the seat cloth 202 as shown in FIG. 2.

In the preferred embodiment, leg members are made of rigid material such as metal tubes. The cup holder 203 can be sewed onto the edge of the seat cloth 202. It may also be clamped on the seat cloth with a clamping device. When the cup holder 203 is fully opened up, it has a substantially cylindrical shape similar to a cup or a can with an empty inside. Therefore, a can or cup can be securely held in the cup holder.

In order to avoid being tipped over due to the weight of a can or cup, the cup holder may be affixed to a corner edge so that it can lean on the leg members of the leg assembly 201. Therefore, it has the support from the leg members when it is holding some weight. As shown in FIG. 2, the cup holder is better supported if it is affixed to the edge of the seat near the back of the chair.

Figure 3:
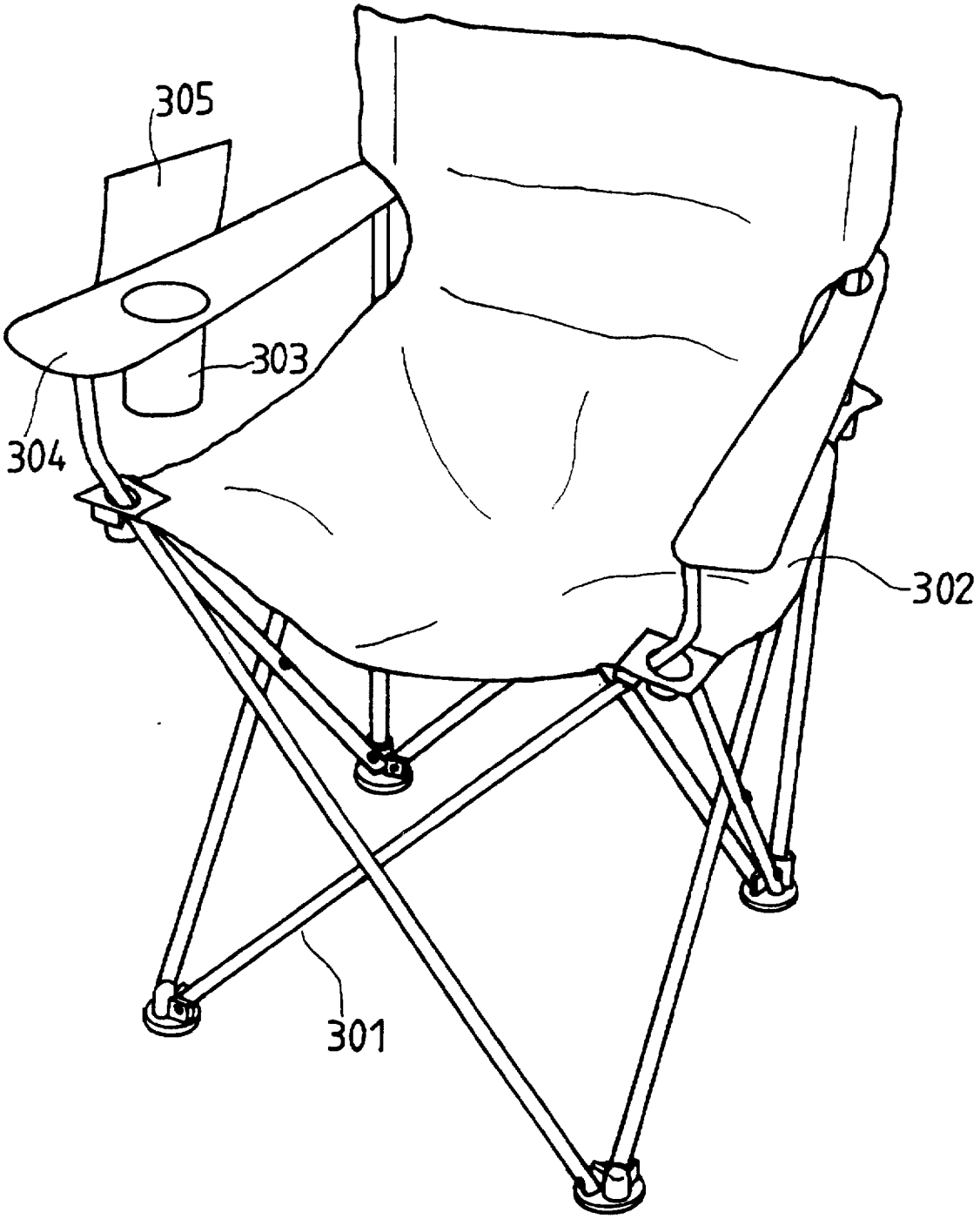
FIG. 3 shows a second embodiment of the foldable chair of this invention in which a collapsible cup holder is integrated into an armrest of the chair.

Another preferred embodiment of the present invention is shown in FIG. 3. The foldable chair also comprises a leg assembly 301, a seat cloth 302, and a bag 303. The basic structure of the foldable chair of this embodiment is similar to that of the chair in FIG. 2 except that it has a pair of armrests 304.

The armrests are made of two pieces of fabric of elongated shape. As can be seen from FIG. 3, a plurality of leg members are extended upward and each piece of the fabric of elongated shape is mounted on the extended leg members to form an armrest 304. The armrests are also made of collapsible material similar to that of the seat cloth 302.

The bag 303 of the foldable chair of FIG. 3 may be affixed to the edge of the seat cloth 302 to serve as a cup holder as shown in FIG. 2. It may also be affixed to an armrest 304. However, in this embodiment, it is preferred that the cup holder 303 be integrated as a part of an armrest as shown in FIG. 3.

The edge of the opening end of the bag is lined up with and affixed to the edge of an opening formed on the armrest. The opening has substantially the same size as that of the opening of the bag. When a cup or can is put into the bag through the armrest opening, the bag is extended downward to form a cup holder for holding the cup or can. The weight is supported by the arm rest.

According to this invention, a flap 305 as shown in FIG. 3 can be attached or affixed near the armrest opening to cover the cup holder. The flap may be made of the same material as the bag or the armrest. One edge of the flap is affixed to the armrest so that the flap can be opened up or closed down. When the cup holder is not in use, it can be hidden completely under the flap.

Although only the preferred embodiments of this invention were shown and described in the above description, various modification or combination that comes within the spirit of this invention may also be made by a person skilled in the field according to the principle described.

What is claimed is:

1. A foldable chair comprising:

a leg assembly having a plurality of leg members pivotedly connected by pivot pins and joined together by joint members, said leg assembly being collapsible and forming a seat support frame when fully opened;

a seat cloth mounted on said leg assembly, said seat cloth forming a seat base for supporting a person and a plurality of said leg members being extended above said seat cloth when said leg assembly is fully opened;

two pieces of elongated cloth being mounted on said extended leg members for forming a pair of armrests;

a bag affixed to an armrest by connecting the edge of the opening of said bag to the edge of an opening formed on the armrest, said bag having the shape of a cup, being extended downward and forming a cup holder for holding a cup if the cup is put into said bag through the opening of the armrest; and a flap attached to the armrest for covering the opening of said bag.

2. The foldable chair according to claim 1, said seat cloth, said elongated cloth of said armrests and said bag being made of canvas or synthetic fabric.

* * * * *